United States Patent [19]

Roderer

[11] Patent Number: 4,955,097

[45] Date of Patent: Sep. 11, 1990

[54] BELT BUCKLE WRENCH

[76] Inventor: Thomas C. Roderer, 308 Washington Ave., Downingtown, Pa. 19335

[21] Appl. No.: 432,372

[22] Filed: Nov. 6, 1989

[51] Int. Cl.[5] ..... B25F 1/00

[52] U.S. Cl. ..... 7/138

[58] Field of Search ..... 7/138, 170, 151, 139; 24/163 R, 163 K; 2/300, 312, 318; 224/163; D2/629, 639; D11/201

[56] References Cited

U.S. PATENT DOCUMENTS

| | | | |
|---|---|---|---|
| 432,323 | 7/1890 | Musham | 7/138 |
| 4,234,987 | 11/1980 | Charette | 7/139 |
| 4,377,249 | 3/1983 | Bockoven | 24/163 R |

*Primary Examiner*—Roscoe V. Parker
*Attorney, Agent, or Firm*—Leon Gilden

[57] ABSTRACT

A wrench is set forth comprising a fixed jaw and a movable jaw with a belt loop pivotally mounted rearwardly of the jaw pair orthogonally relative to an elongate handle organization of the wrench structure with an "L" shaped hook positioned in a spaced relationship relative to the loop to enable a belt to be secured to the wrench structure. A further embodiment of the invention utilizes a support plate with a slot extending medially of the plate for reception of the hook therethrough with overlying and spaced "L" shaped legs for receiving and securing the wrench therebetween for use in a belt organization.

2 Claims, 3 Drawing Sheets

BELT BUCKLE WRENCH

BACKGROUND OF THE INVENTION

1. Field of the Invention

The field of invention relates to wrench structures, and more particularly pertains to a new and improved belt buckle wrench organization wherein the same is selectively securable to an associated belt structure and utilizes as desired in a tool environment.

2. Description of the Prior Art

The prior art has utilized wrenches for various applications. Wrenches of the prior art, however, have typically been positioned within tool boxes and the like until their use is available. The instant invention attempts to overcome deficiencies of the prior art by providing a wrench structure utilized as a belt buckle to provide convenient access to the wrench when needed by an individual. Examples of the prior art include U.S. Pat. No. 4,260,087 to Leaver illustrating the use of a western style belt buckle formed with clip structure to secure a pistol releasably thereto.

U.S. Pat. No. 8,272,410 to Reisman sets forth a key structure utilized as a belt fastening member, or alternatively a watch, provided with clips for the same purpose.

U.S. Pat. No. 4,466,561 to Slaughter sets forth a knife structure provided with a loop and a clip for securement of the knife to an associated belt organization.

U.S. Pat. No. 4,481,712 to Phelps provides a folding knife securable to a base plate that is in turn securable to a flexible belt organization.

U.S. Pat. No. 4,521,939 to Chabot, et al., provides a belt buckle formed with sleeve for receiving a key therewithin for subsequent use by an individual.

As such, it may be appreciated that there is a continuing need for a new and improved belt buckle wrench organization which addresses both the problems of ease of use and effectiveness in organization and in this respect, the present invention substantially fulfills this need.

SUMMARY OF THE INVENTION

In view of the foregoing disadvantages inherent in the known types of buckle organizations now present in the prior art, the present invention provides a belt buckle wrench wherein the same provides a releasably mounted belt buckle wrench in association with a belt for selective use of a tool as desired. As such, the general purpose of the present invention, which will be described subsequently in greater detail, is to provide a new and improved belt buckle wrench which has all the advantages of the prior art belt buckle organizations and none of the disadvantages.

To attain this, the present invention includes a wrench structure formed with a fixed jaw and a movable jaw with the fixed jaw associated with an elongate handle and a belt buckle loop hingedly mounted to a belt buckle hinged loop secured to the associated handle orthogonally relative thereto with an "L" shape hook spaced rearwardly of the jaws and the belt buckle securement loop for association with apertures of an associated flexible belt. A modification of this invention utilizes a slotted plate for receiving the "L" shaped hook therethrough for cooperation with a belt with spaced opposed "L" shaped legs formed of magnetic material to secure the wrench in association with the support plate.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved belt buckle wrench which has all the advantages of the prior art belt buckle organizations and none of the disadvantages.

It is another object of the present invention to provide a new and improved belt buckle wrench which may be easily and efficiently manufactured and marketed.

It is a further object of the present invention to provide a new and improved belt buckle wrench which is of a durable and reliable construction.

An even further object of the present invention is to provide a new and improved belt buckle wrench which is susceptible of a low cost of manufacture with regard to both materials and labor, and which accordingly is then susceptible of prices of sale to the consuming public, thereby making such belt buckle wrenches economically available to the buying public.

Still yet another object of the present invention is to provide a new and improved belt buckle wrench which provides in the apparatuses and methods of the prior art some of the advantages thereof, while simultaneously overcoming some of the disadvantages normally associated therewith.

Still another object of the present invention is to provide a new and improved belt buckle wrench releasably mounted relative to an associated flexible belt for selective use by an individual as desired.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
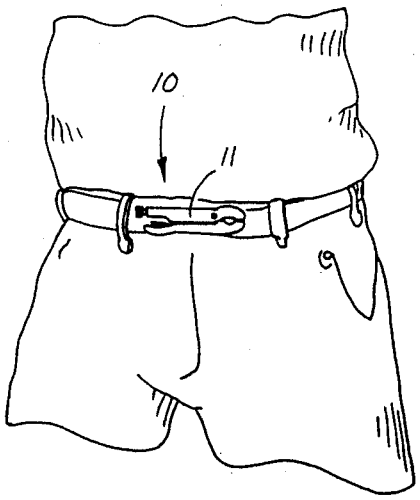
FIG. 1 is an isometric illustration of the instant invention in use by an individual.

With reference now to the drawings, and in particular to FIGS. 1 to 6 thereof, a new and improved belt buckle wrench embodying the principles and concepts of the present invention and generally designated by the reference numerals 10 and 10*a* will be described.

More specifically, the belt buckle wrench 10 of the instant invention essentially comprises a wrench structure 11 formed with a fixed rod 12 in cooperative association with a movable jaw 13 A rearwardly extending handle portion 11*a* of the wrench structure 11 includes a hinge loop 14 orthogonally and integrally mounted to a rear surface of the handle structure 11*a*. A belt securement loop 15 of a length substantially greater than that of a predetermined width defined by the handle structure 11*a* is mounted through and in pivotal relationship to the hinged loop 14 for receiving a fixed end 1 of a belt. An "L" shaped hook 16 is mounted rearwardly of the hinge loop 14 with the free end of the "L" shaped hook 16 oriented towards the hinged loop 14 and in a general alignment with the handle 11*a*. Accordingly, a free end 2 of a belt formed with a conventional series of aligned apertures is directed rearwardly of the wrench 11 with a free end aperture directed through the "L" shaped hook 16 to secure the wrench 11 to an associated belt, as illustrated in FIG. 1 for example.

Figure 2:
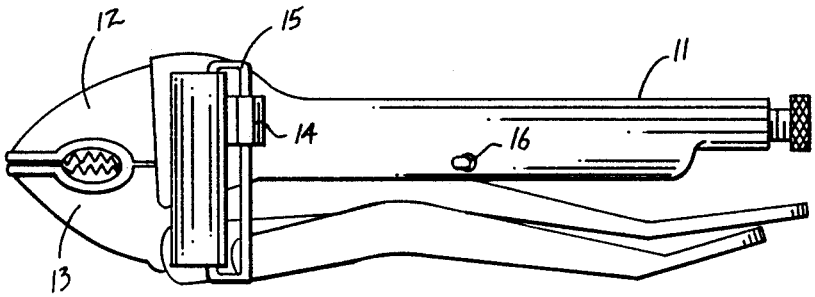
FIG. 2 is a rear orthographic view of the wrench structure of the instant invention.
Figure 3:
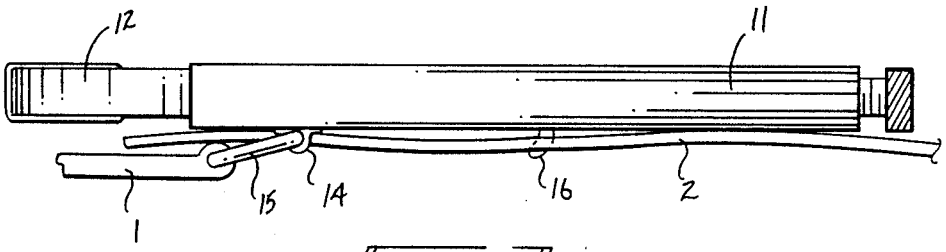
FIG. 3 is a top orthographic view of the wrench structure of the instant invention.
Figure 4:
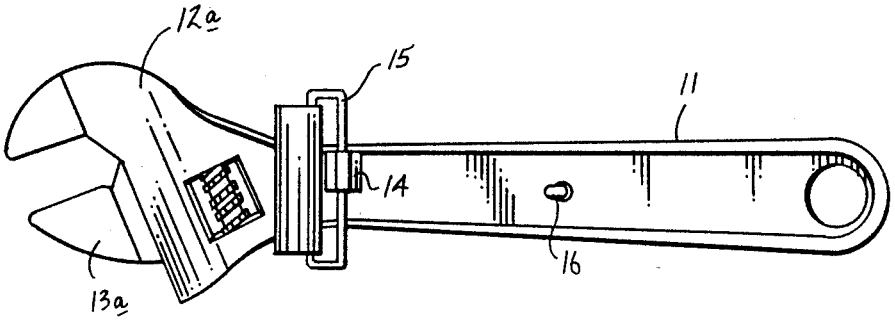
FIG. 4 is a rear orthographic view taken in elevation of an alternative wrench structure utilized by the instant invention.

FIG. 4 is illustrative of a modified wrench 21 utilizing an elongate handle formed with a fixed jaw 12*a* and a movable jaw 13*a* with the hinge loop 14 and the securement loop 15 and associated "L" shaped hook 16 arranged in a similar manner as illustrated and described in relation to FIGS. 2 and 8.

Figure 5:
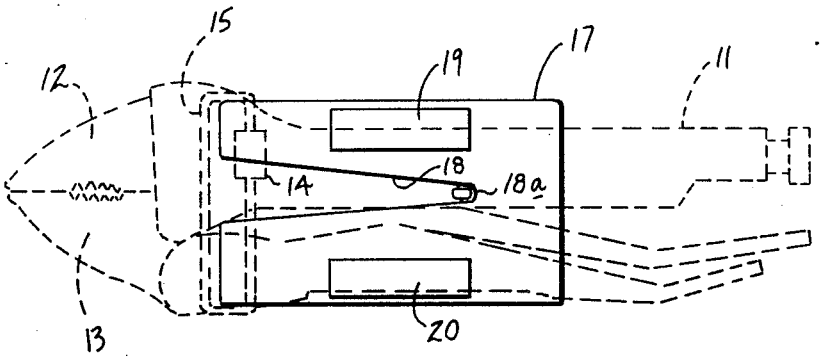
FIG. 5 is a frontal orthographic view taken in elevation of an alternative wrench belt buckle organization utilized by the instant invention.
Figure 6:
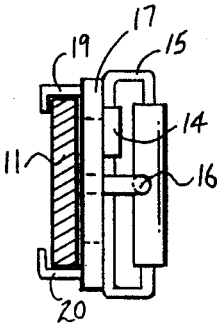
FIG. 6 is an orthographic side view of the invention as illustrated in FIG. 5.

FIG. 5 is illustrative of a modified belt buckle wrench organization 10*a* utilizing a belt buckle support plate 17 of a generally planar organization formed with an elongate slot 18 extending medially of the plate 17 formed with a terminal end 18*a*. The wrench 11 or 21 is thereby mounted to the support plate 17 and is captured therebetween in cooperation with an upper and lower "L" shaped leg 19 and 20 formed with magnetic material to secure to the wrench 11 or 21 therebetween. The "L" shaped hook 16 may thereby extend rearwardly and through the slot 18 and in cooperation with the belt securement loop 15 secures a fixed end 1 of the belt and enables the hook 16 to cooperate with the free end of the belt in a manner as described above.

As to the manner of usage and operation of the instant invention, the same should be apparent from the above disclosure, and accordingly, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United is as follows:

1. A belt buckle wrench for use with a belt that includes a fixed end and a free end, wherein the free end includes a series of apertures, the apparatus comprising, a wrench member including a fixed jaw mounted at a forward terminal end of a handle, and a movable jaw mounted for cooperation with a fixed jaw for securement of a workpiece therebetween, and a first means pivotally mounted to the handle for securement of the fixed end of the belt thereto, and a second belt mounting means mounted on the handle rearwardly of the first means and of the fixed jaw for directing through one of said apertures of the free end of the belt to secure the front of the belt relative to the wrench member, and the first means includes a hinged loop integrally mounted to the rear surface of the handle and arranged orthogonally relative to the handle and pivotally mounting a continuous belt securement loop therethrough in a pivotal movable relationship relative to the hinged loop, and the second means includes an "L" shaped hook, the "L" shaped hook fixedly mounted on the rear surface of the handle with the free end of the hook aligned with the handle and directed towards the hinged loop and belt securement loop, and further including a support plate, the support plate defined by a predetermined length less than that of the wrench, and formed with an elongated slot oriented medially of the plate and terminating at a mid portion of the plate for receiving the "L" shaped hook therethrough.

2. A belt buckle wrench as set forth in claim 1 wherein the plate further includes an upper and lower "L" shaped leg formed of magnetic material wherein each leg is aligned with and directed towards an opposing leg for securement of the wrench therebetween.

* * * * *